United States Patent [19]

Block

[11] 4,109,424

[45] Aug. 29, 1978

[54] LIGHTWEIGHT AND COMPACTIBLE TENT STRUCTURE

[76] Inventor: Gerald H. Block, 3111 Deakin St., Berkeley, Calif. 94705

[21] Appl. No.: 800,567

[22] Filed: May 25, 1977

[51] Int. Cl.[2] ..... E04B 1/345

[52] U.S. Cl. ..... 52/2; 135/1 R

[58] Field of Search ..... 52/2; 135/1 R, 3 R, 135/14 D; 5/343

[56] References Cited

U.S. PATENT DOCUMENTS

| | | | |
|---|---|---|---|
| 1,204,416 | 11/1916 | Doser | 5/343 |
| 2,259,267 | 10/1941 | Ranken | 135/1 R X |
| 2,915,074 | 12/1959 | Cameto | 52/2 |
| 3,241,269 | 3/1966 | Reffell | 52/2 |
| 3,464,430 | 9/1969 | McQuaid | 135/1 R |
| 3,840,919 | 10/1974 | Middleton | 135/1 R X |
| 4,068,674 | 1/1978 | Mitchell | 52/2 X |

FOREIGN PATENT DOCUMENTS

| | | | |
|---|---|---|---|
| 545,219 | 6/1956 | Italy | 52/2 |

OTHER PUBLICATIONS

Ins-Tent Shelter Catalog, Jan. 30, 1975.

*Primary Examiner*—Werner H. Schroeder
*Assistant Examiner*—Conrad L. Berman
*Attorney, Agent, or Firm*—Bruce & McCoy

[57] ABSTRACT

A lightweight and compactible tent structure comprising a single support member preferably having an inverted U shape and preferably being fabricated from a section of inflatable plastic tubing, stake receiving loops affixed to the ends of the support member for anchoring the support member to the ground, a guy line extending in one direction from the support member, and a protective surround attached at one of its ends to the support member and extending therefrom in the direction opposite the guy line, said protective surround tapering at its extended end to engage the body of the camper who reposes in the tent structure whereby the weight of the camper's body engaging the surround coacts with the supporting force of the guy line and the anchoring force of stakes placed in the ground through the support member's stake receiving loops to hold the tent structure in a fixed upright position.

9 Claims, 4 Drawing Figures

LIGHTWEIGHT AND COMPACTIBLE TENT STRUCTURE

BACKGROUND OF THE INVENTION

1. Field of the Invention

The present invention relates to camping equipment, and more particularly to tent structures, and still more particularly to a lightweight and fully compactible tent structure which can be packed away in a very small, convenient, and easy to carry location.

2. Description of the Prior Art

The types and varieties of tent structures which have been designed and made available to the market are manifold. Although most conventional tent structures are collapsible and although many are designed with lightweight metals, all are still relatively bulky and heavy for a camper who wishes to minimize the weight and volume of the equipment he carries.

The present invention overcomes the weight and volume problem of conventional tent structures by providing a lightweight and fully compactible tent structure which when set up will entirely enclose and protect the upper and exposed portion of a camper's body when the camper is reposed on the ground in a sleeping bag. It is contemplated that the tent structure according to the design described in detail below will compact into a volume which can be easily accommodated in a duffel bag, backpack, or even inside the camper's sleeping bag.

SUMMARY OF THE INVENTION

The present invention is a lightweight and compactible tent structure for protecting at least the upper portion of a camper's body. The tent structure is comprised of at least one support member which is fabricated from a lightweight and substantially flexible material, but which has sufficient rigidity, when deployed, to stand in a substantially vertical upright position. Means are provided for anchoring this support member to the ground. A protective surround is attached to the support member and extends therefrom to form an extended end portion which engages the body of a camper who reposes in the tent structure such that the weight of the camper's body engaging the surround in addition to the support of the anchored and lightweight support member combine to hold the tent structure in a relatively fixed upright position.

OBJECTS OF THE INVENTION

It is therefore an object of the present invention to provide a tent structure which is extremely lightweight and which particularly eliminates the need for comparatively heavy and bulky support members such as wood or metal.

It is another object of the present invention to provide a tent structure which is fully compactible to a volume small enough to conveniently fit within a small duffel bag, backpack, or even the camper's sleeping bag.

It is a further object of the present invention to provide a tent structure which provides for the camper's comfort by fully protecting the upper portion of a camper's body from insects, and from ground moisture.

It is still another object of the present invention to provide a tent structure which can be manufactured at relatively low cost.

Still other objects of the invention will become apparent from the following specification and claims.

DESCRIPTION OF THE PREFERRED EMBODIMENT

Figure 1:
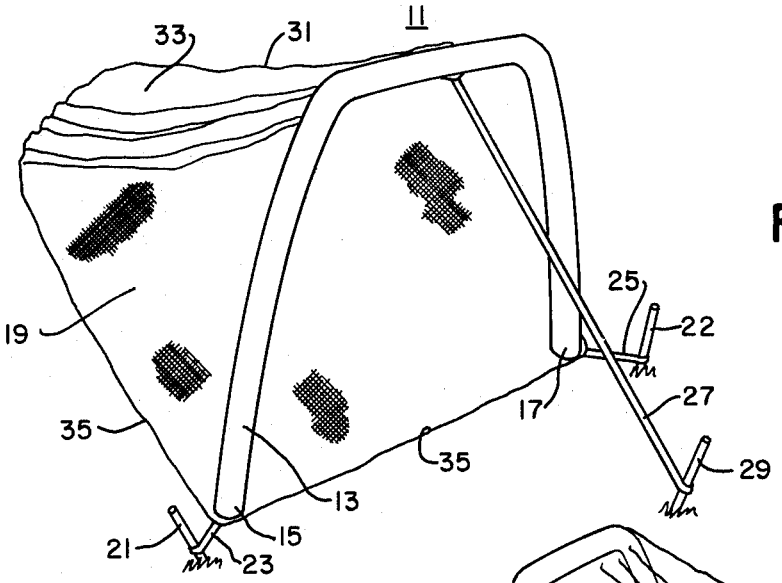
FIG. 1 is a perspective view showing a preferred embodiment of a lightweight and compactible tent structure according to the present invention.
Figure 2:
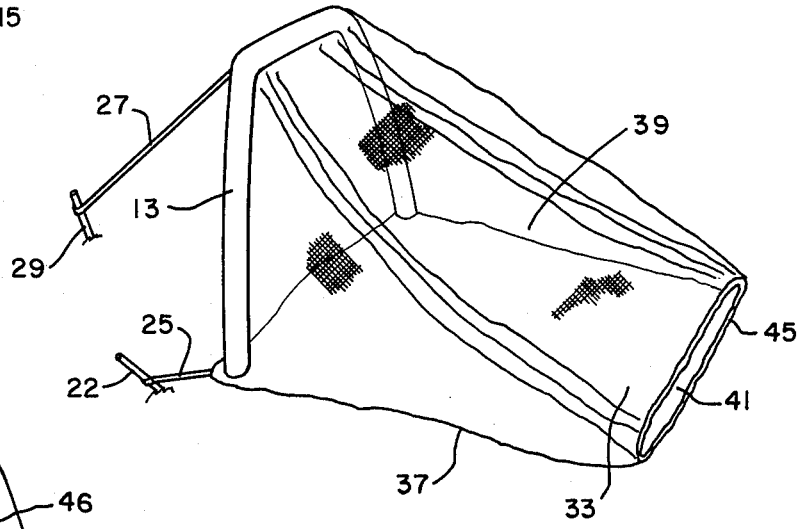
FIG. 2 is another perspective view of the tent structure shown in FIG. 1.
Figure 3:
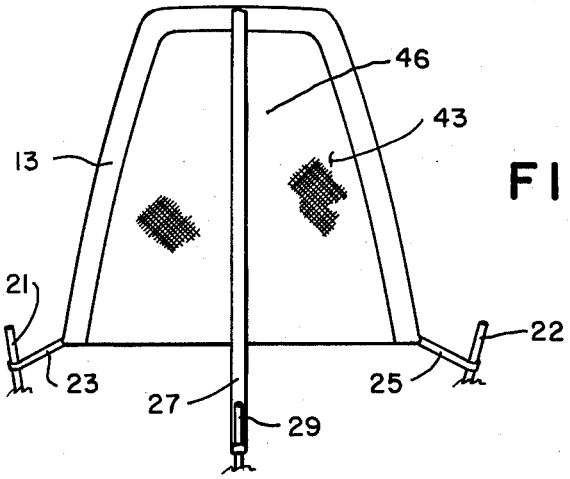
FIG. 3 is a front elevational view thereof.

Referring now to the drawings, the preferred embodiment of the fully compactible tent structure of the present invention is shown in FIGS. 1 through 4 as it would look in its set up position. The tent structure, denoted generally as 11, is comprised of at least one support member 13 fabricated from a material which is lightweight and substantially flexible to permit the support member to be easily compacted into a small volume suitable for convenient storing in a backpack, or the like. Although lightweight and flexible, the support member when in the shown deployed position would also necessarily have to have sufficient rigidity to stand in a substantially vertical upright position. To achieve this the support member is preferably fabricated from an inflatable plastic tubing whereby the fully inflated tubing provides substantial structural rigidity, but whereby the support member can be collapsed by deflation to a fraction of its inflated size. It has been found that tubing fabricated of 8 mil wall polyvinyl cloride and having a diameter of approximately 2 to 3 inches provides a very suitable support member construction. However, it should be understood that other plastic materials and other dimensions might also be employed. It is also understood that, as an alternative to an inflatable support member, a section of open cell polyurethane foam, or the like, might also be used, however, such a construction would have less compactability than a deflatable structure.

As shown, the support member 13 preferably has an inverted U shape such that its two ends 15 and 17 stand on the ground to support the protective surround 19 which extends from one side of the support member. The support member 13 is partially held or anchored in its upright position by stakes 21 and 22, which are inserted, respectively, through stake receiving loops 23 and 25, and by a single guy line 27 secured to a stake 29 suitably positioned in front of the support member. As will be described, the weight of the upper body portion of a camper lying in the protective surround 19 provides the additional anchoring required to keep the support member firmly upright thereby keeping the entire tent structure in its deployed position.

By using the camper's body to partially support the tent structure of the present invention much of the relatively extensive support structure found in conventional tents has been eliminated; in fact, by employing the light weight support member construction above-described, a tent according to the present invention can be fabricated which, including stakes, weighs less than twelve ounces or approximately one-fifth of the weight (typically 55 to 90 ounces) of conventional light weight structures.

Figure 4:
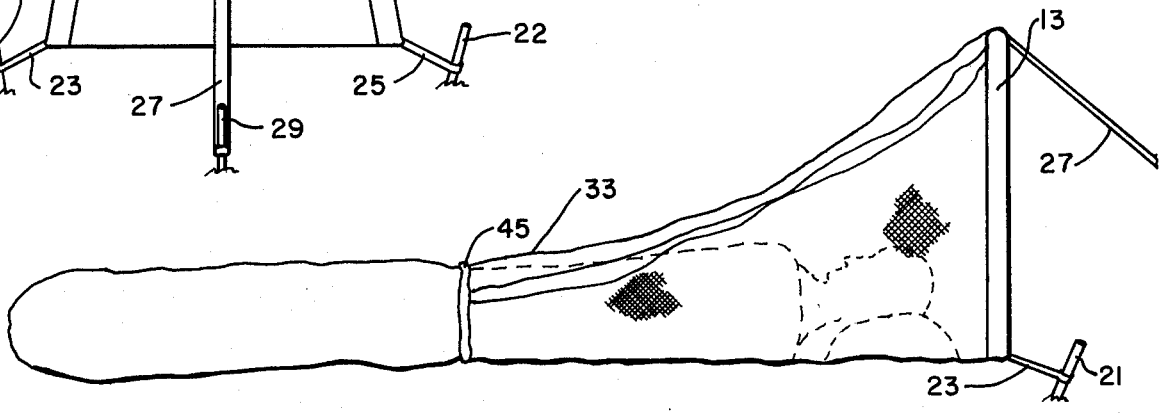
FIG. 4 is a side elevational view thereof showing a camper lying head first in the tent structure.

As seen in the figures of the drawings, the protective surround 19 is formed in part by a cover material 31 attached at one of its ends along the length of the support member 13. The cover material extends from the support member and tapers such that the protective surround 19 has an extended end portion which engages the body of a camper who is reposing in the tent structure as shown in FIG. 4. Preferably, the cover material of the surround is fabricated from a mesh material for air permeability and also preferably the surround will further consist of a moisture impervious ground cloth material 35 which extends from the bottom ends 15, 17 of the support member 13 to form a bottom portion of the surround 19. The mesh material and ground cover material are attached by sewing together their respective extended side edges 37, 39, and, as can be seen, the sewn together mesh material and ground cloth material combine to form a somewhat tubular shaped element which tapers at its extended end 33 until it terminates to form an access opening 41 through which a camper can crawl to enter the tent structure. The surround is preferably of a length whereby the access opening will engage the camper's sleeping bag approximately at the mid portion of the camper's body, and by the camper lying on the ground cloth with the extended end 33 of the surround gathered around his body it is clearly seen that the camper's body tends to hold the tent strucutre 11 in its upright position; it is also seen that the gathered material around the body of the camper will prevent any insects from accessing the enclosure defined by the surround. To complete the surround enclosure a second mesh material 43 is secured across the end opening 46 defined by the inverted U shaped support member 13.

Although the surround of the tent structure of the present invention is shown and has been described as being supported by a single inverted U shaped support member, preferably fabricated from inflatable plastic tubing, it is contemplated that further support might be provided by using additional support members of the same lightweight and collapsible construction.

It is noted that the access opening 41 at the tapered end of the surround can be provided with a reinforcement material and preferably with an elastic material 45 held by a casing sewn into the end of the surround. Such an elastic material would act to gather the tapered end of the surround tightly around the body of the camper. Alternatively, a draw cord might be provided whereby gathering of the material can be accomplished by the camper pulling from the inside on the loose end of the cord. Again, the purpose is to gather the surround material closely around the camper's body to provide a tight enclosure which will be inaccessible by all types of insects.

The present invention is therefore a very lightweight and totally compactible tent structure which could be easily carried in a camper's duffel bag, backpack, sleeping bag, or the like and which will serve to provide a sleeping camper with protection from the usual high concentration of insects found in backpacking areas. The unique tent structure above-described also has the advantage of being extremely simple to set up and should be less expensive to manufacture when compared to conventional tent structures with more rigid metal or wood support frames.

Although the present invention has been described in considerable detail in the above specification, it is not intended that it be limited to such detail, except as may be necessitated by the appended claims.

What I claim is:

1. A lightweight and compactible tent structure for protecting at least the upper exposed portion of a camper's body, said tent structure comprising a support member fabricated of a lightweight substantially flexible material wherein the support member can be compacted into a small volume suitable for storing, said support member, however, having sufficient rigidity in its non-compacted condition to stand in a substantially vertical upright position, means for anchoring said support member to the ground, and a protective surround attached to said support member and extending therefrom to form an extended end portion which engages the body of a camper who reposes in said tent structure such that the weight of the camper's body engaging said surround and the support provided by said anchored lightweight support member coact to hold said tent structure in a stable upright position.

2. The lightweight and compactible tent structure of claim 1 wherein said support member is fabricated of inflatable plastic tubing.

3. The lightweight and compactible tent structure of claim 1 wherein said support member has an inverted U-shape and a second cover material is secured across the end opening formed by the upright position of said inverted U-Shaped support member.

4. The lightweight and compactible tent structure of claim 1 wherein the top portion of said protective surround is fabricated of a mesh material.

5. The lightweight and compactible tent structure of claim 4 wherein said protective surround further includes a moisture impervious ground cover material.

6. The lightweight and compactible tent structure of claim 5 wherein the access opening of said tubular surround is adapted to be cinched around the camper's body to provide a tight, air pervious enclosure around the upper portion of the camper's body.

7. A light weight and compactible tent structure for protecting at least the upper exposed portion of a camper's body, said tent structure comprising an inverted U-shaped support member fabricated of inflatable plastic tubing, means for anchoring said support member to the ground, a mesh cover material attached to said support member and extending therefrom, a water impervious ground cover material extending from said support member and having extended side edges which are secured to the extended side edges of said mesh material so as to form an extended tubular shaped protective surround, said surround tapering to an extended end portion having an access opening through which a camper reposing in said tent structure can fit, said protective surround being of a length whereby its extended end portion engages approximately the mid portion of the camper's body such that the weight of the camper's body engaging said surround and the support provided by said anchored inflatable support member coact to hold said tent structure in a stable upright position, and said protective surround further including a second mesh material secured across the end opening formed by the upright position of said inverted U-shaped support member whereby there is provided a complete protective enclosure to protect the upper portion of the camper's body such as against insects found in a camping environment.

8. The lightweight and collapsible tent structure of claim 7 wherein the access opening of said protective surround has a draw cord whereby the tapered end of said surround can be cinched around the camper's body.

9. The lightweight and compactible tent structure of claim 7 wherein said means for anchoring said support member includes stake receiving loops secured to the ends of said inverted U-shaped support member and a guy line attached to the top end of said support member and adapted to be extended for staking in the opposite direction from said protective surround whereby said tent structure is held in a fixed, upright position by said guy line, the staked ends of said support member, and the weight of the camper reposing therein.

* * * * *